US010195871B1

(12) United States Patent
Moore et al.

(10) Patent No.: US 10,195,871 B1
(45) Date of Patent: Feb. 5, 2019

(54) PATTERNED PREHEAT FOR DIGITAL OFFSET PRINTING APPLICATIONS

(71) Applicants: Xerox Corporation, Norwalk, CT (US); Palo Alto Research Center Incorporated, Palo Alto, CA (US)

(72) Inventors: Steven R. Moore, Pittsford, NY (US); Palghat S. Ramesh, Pittsford, NY (US); Alex S. Brougham, Webster, NY (US)

(73) Assignees: XEROX CORPORATION, Norwalk, CT (US); PALO ALTO RESEARCH CENTER INC., Palo Alto, CA (US)

( * ) Notice: Subject to any disclaimer, the term of this patent is extended or adjusted under 35 U.S.C. 154(b) by 0 days.

(21) Appl. No.: 15/872,396

(22) Filed: Jan. 16, 2018

(51) Int. Cl.

| | |
|---|---|
| ***B41F 7/24*** | (2006.01) |
| ***B41J 2/325*** | (2006.01) |
| ***B41F 19/00*** | (2006.01) |
| ***B41J 2/345*** | (2006.01) |

(52) U.S. Cl.
CPC ..... *B41J 2/325* (2013.01); *B41F 7/24* (2013.01); *B41F 19/007* (2013.01); *B41J 2/345* (2013.01)

(58) Field of Classification Search
CPC ... B41J 2/325; B41J 2/345; B41F 7/24; B41F 19/007
See application file for complete search history.

(56) References Cited

U.S. PATENT DOCUMENTS

| | | | | |
|---|---|---|---|---|
| 8,347,787 | B1 | 1/2013 | Stowe et al. | |
| 9,021,948 | B2 * | 5/2015 | Pattekar | G03G 15/10 101/148 |
| 9,032,874 | B2 * | 5/2015 | Liu | B41F 7/32 101/147 |
| 9,643,397 | B2 * | 5/2017 | Stowe | B41F 7/00 |
| 2012/0103212 | A1 * | 5/2012 | Stowe | B41C 1/1041 101/147 |
| 2013/0247788 | A1 | 9/2013 | Liu et al. | |
| 2015/0309413 | A1 * | 10/2015 | Liu | G03F 7/16 355/27 |
| 2015/0375497 | A1 * | 12/2015 | Stowe | B41F 35/04 101/348 |
| 2016/0176186 | A1 * | 6/2016 | Raychaudhuri | B41J 2/0057 101/453 |

* cited by examiner

*Primary Examiner* — Huan Tran
(74) *Attorney, Agent, or Firm* — Caesar Rivise, PC

(57) ABSTRACT

A thermal printhead (TPH) is positioned to selectively preheat a blanket surface such as an arbitrarily reimageable surface of a variable lithography system. The blanket then immediately passes through a chamber containing dampening solution vapor. The vapor condenses only where the blanket has not been heated, thus developing an image ready for inking.

20 Claims, 7 Drawing Sheets

PATTERNED PREHEAT FOR DIGITAL OFFSET PRINTING APPLICATIONS

BACKGROUND OF THE INVENTION

The present disclosure is related to marking and printing systems, and more specifically to variable data lithography system employing patterned preheat with a thermal print head.

Offset lithography is a common method of printing today. For the purpose hereof, the terms "printing" and "marking" are interchangeable. In a typical lithographic process a printing plate, which may be a flat plate, the surface of a cylinder, belt, and the like, is formed to have "image regions" formed of hydrophobic and oleophilic material, and "non-image regions" formed of a hydrophilic material. The image regions are regions corresponding to the areas on the final print (i.e., the target substrate) that are occupied by a printing or a marking material such as ink, whereas the non-image regions are the regions corresponding to the areas on the final print that are not occupied by the marking material.

The Variable Data Lithography (also referred to as Digital Lithography or Digital Offset) printing process usually begins with a fountain solution used to dampen a silicone imaging plate on an imaging drum. The fountain solution forms a film on the silicone plate that is on the order of about one (1) micron thick. The drum rotates to an 'exposure' station where a high power laser imager is used to remove the fountain solution at the locations where the image pixels are to be formed. This forms a fountain solution based 'latent image'. The drum then further rotates to a 'development' station where lithographic-like ink is brought into contact with the fountain solution based 'latent image' and ink 'develops' onto the places where the laser has removed the fountain solution. The ink is usually hydrophobic for better placement on the plate and substrate. An ultra violet (UV) light may be applied so that photo-initiators in the ink may partially cure the ink to prepare it for high efficiency transfer to a print media such as paper. The drum then rotates to a transfer station where the ink is transferred to a printing media such as paper. The silicone plate is compliant, so an offset blanket is not used to aid transfer. UV light may be applied to the paper with ink to fully cure the ink on the paper. The ink is on the order of one (1) micron pile height on the paper.

The formation of the image on the printing plate is usually done with imaging modules each using a linear output high power infrared (IR) laser to illuminate a digital light projector (DLP) multi-mirror array, also referred to as the "DMD" (Digital Micromirror Device). The mirror array is similar to what is commonly used in computer projectors and some televisions. The laser provides constant illumination to the mirror array. The mirror array deflects individual mirrors to form the pixels on the image plane to pixel-wise evaporate the fountain solution on the silicone plate. If a pixel is not to be turned on, the mirrors for that pixel deflect such that the laser illumination for that pixel does not hit the silicone surface, but goes into a chilled light dump heat sink. A single laser and mirror array form an imaging module that provides imaging capability for approximately one (1) inch in the cross-process direction. Thus a single imaging module simultaneously images a one (1) inch by one (1) pixel line of the image for a given scan line. At the next scan line, the imaging module images the next one (1) inch by one (1) pixel line segment. By using several imaging modules, comprising several lasers and several mirror-arrays, butted together, imaging function for a very wide cross-process width is achieved.

Due to the need to evaporate the fountain solution, in the imaging module, power consumption of the laser accounts for the majority of total power consumption of the whole system. Such being the case, a variety of power saving technologies for the imaging modules have been proposed. For example, the schemes to reduce the size of the image formed on the printing plate, changing the depth of the pixel, and substituting less powerful image creating source such as a conventional Raster Output Scanner (ROS). To evaporate a one (1) micron thick film of water, at process speed requirements of up to five meters per second (5 m/s), requires on the order of 100,000 times more power than a conventional xerographic ROS imager. In addition, cross-process width requirements are on the order of 36 inches, which makes the use of a scanning beam imager problematic. Thus a special imager design is required that reduces power consumption in a printing system. An over looked area of power conservation is the use of non-laser imagers.

For the reasons stated above, and for other reasons stated below which will become apparent to those skilled in the art upon reading and understanding the present specification, there is a need in the art for lowering power consumption in variable data lithography system.

BRIEF SUMMARY OF THE INVENTION

According to aspects of the embodiments, the present disclosure relates to variable lithography using a thermal printhead (TPH) that is positioned to selectively preheat a blanket surface such as an arbitrarily reimageable surface. The blanket then immediately passes through a chamber containing dampening solution vapor. The vapor condenses only where the blanket has not been heated, thus developing an image ready for inking.

DETAILED DESCRIPTION OF THE INVENTION

Figure 1:
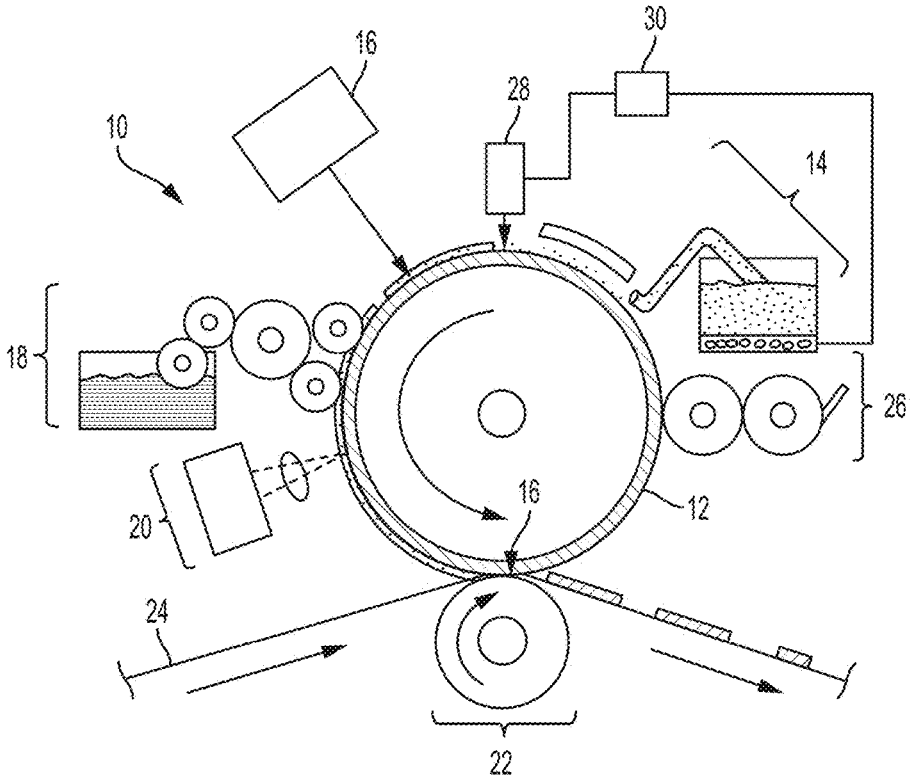
FIG. 1 RELATED ART
FIG. 1 illustrates a block diagram of a system that shows a related art ink-based digital printing system.

Exemplary embodiments are intended to cover all alternatives, modifications, and equivalents as may be included within the spirit and scope of the composition, apparatus and systems as described herein.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof. In the drawing, like reference numerals are used throughout to designate similar or identical elements.

In one aspect, an apparatus useful in printing with a variable data lithographic system having an arbitrarily reimageable surface comprising a thermal printhead (TPH) element disposed proximate the arbitrarily reimageable surface; driving circuitry communicatively connected to the thermal printhead for selectively temporarily heating the thermal printhead to an elevated temperature; whereby portions of the arbitrarily reimageable surface proximate the thermal printhead are heated by the thermal printhead when the thermal printhead is at the elevated temperature; a flow control structure that confines airborne dampening fluid provided from a flow conduit to a condensation region to support forming a dampening fluid layer with voids at the arbitrarily reimageable surface.

In another aspect, the apparatus wherein the thermal printhead comprises a substrate having distal end; a thermal element carried by the substrate at the distal end; whereby the thermal printhead is disposed within the variable data lithographic system such that the distal end of the substrate is closer to the arbitrarily reimageable surface.

In yet another aspect, the apparatus of wherein the thermal element comprises an array of thermal resistors.

In another aspect, the apparatus wherein the driving circuitry is further carried by the substrate.

In another aspect, the apparatus wherein the thermal printhead is disposed so as to be in physical contact with the arbitrarily reimageable surface when the thermal printhead is at the elevated temperature.

In yet a further aspect, the apparatus wherein the flow control structure is a manifold having at least one nozzle formed therein so as to direct a gas flow from the manifold in the direction of the arbitrarily reimageable surface in the condensation region; and, wherein the heated portions of the arbitrarily reimageable surface proximate the thermal printhead exceed a temperature in the condensation region such that condensation of dampening fluid on the heated portions is inhibited.

In still another aspect, the apparatus wherein the flow control structure is immediately adjacent and downstream of the thermal printhead element.

In still another aspect, wherein the flow conduit is maintained at a temperature such that condensation of dampening fluid on the flow conduit is inhibited and further comprising a dampening fluid reservoir configured to provide through the flow conduit dampening fluid in an airborne state to the arbitrarily reimageable surface.

In still yet a further aspect, a method of forming a latent image over an arbitrarily reimageable surface of an imaging member for receiving ink and transfer of said ink to a print substrate, comprising producing a latent image on said arbitrarily reimageable surface by: disposing a thermal printhead element in contact with said arbitrarily reimageable surface layer; driving the thermal printhead to selectively temporarily heat said thermal printhead to an elevated temperature, whereby portions of said arbitrarily reimageable are heated when said thermal printhead is at said elevated temperature; confining with a flow control structure and a flow conduit a condensation region to support forming a dampening fluid layer with voids at the arbitrarily reimageable surface; applying ink over said arbitrarily reimageable surface layer such that said ink selectively occupies said voids to thereby produce an inked latent image; and transferring the inked latent image to a print substrate.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The terms "dampening fluid", "dampening solution", and "fountain solution" generally refer to a material such as fluid that provides a change in surface energy. The solution or fluid can be a water or aqueous-based fountain solution which is generally applied in an airborne state such as by steam or by direct contact with an imaging member through a series of rollers for uniformly wetting the member with the dampening fluid. The solution or fluid can be non-aqueous consisting of, for example, silicone fluids (such as D3, D4, D5, OS10, OS20 and the like), and polyfluorinated ether or fluorinated silicone fluid.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

The term "printing device" or "printing system" as used herein refers to a digital copier or printer, scanner, image printing machine, digital production press, document processing system, image reproduction machine, bookmaking machine, facsimile machine, multi-function machine, or the like and can include several marking engines, feed mechanism, scanning assembly as well as other print media processing units, such as paper feeders, finishers, and the like. The printing system can handle sheets, webs, marking materials, and the like. A printing system can place marks on any surface, and the like and is any machine that reads marks on input sheets; or any combination of such machines.

The term "print media" generally refers to a usually flexible, sometimes curled, physical sheet of paper, substrate, plastic, or other suitable physical print media substrate for images, whether precut or web fed.

FIG. 1 shows a related art ink-based digital printing system for variable data lithography according to one embodiment of the present disclosure. System 10 comprises an imaging member 12 or arbitrarily reimageable surface since different images can be created on the surface layer, in this embodiment a blanket on a drum, but may equivalently be a plate, belt, or the like, surrounded by condensation-based dampening fluid subsystem 14, discussed in further detail below, optical patterning subsystem 16, inking subsystem 18, transfer subsystem 22 for transferring an inked image from the surface of imaging member 12 to a substrate 24, and finally surface cleaning subsystem 26. Other optional other elements include a rheology (complex viscoelastic modulus) control subsystem 20, a thickness measurement subsystem 28, control subsystem 30, etc. Many additional optional subsystems may also be employed, but are beyond the scope of the present disclosure. As noted above, optical patterning subsystem 16 is complex, expensive, and accounts for the majority of total power consumption of the whole system.

Figure 2:
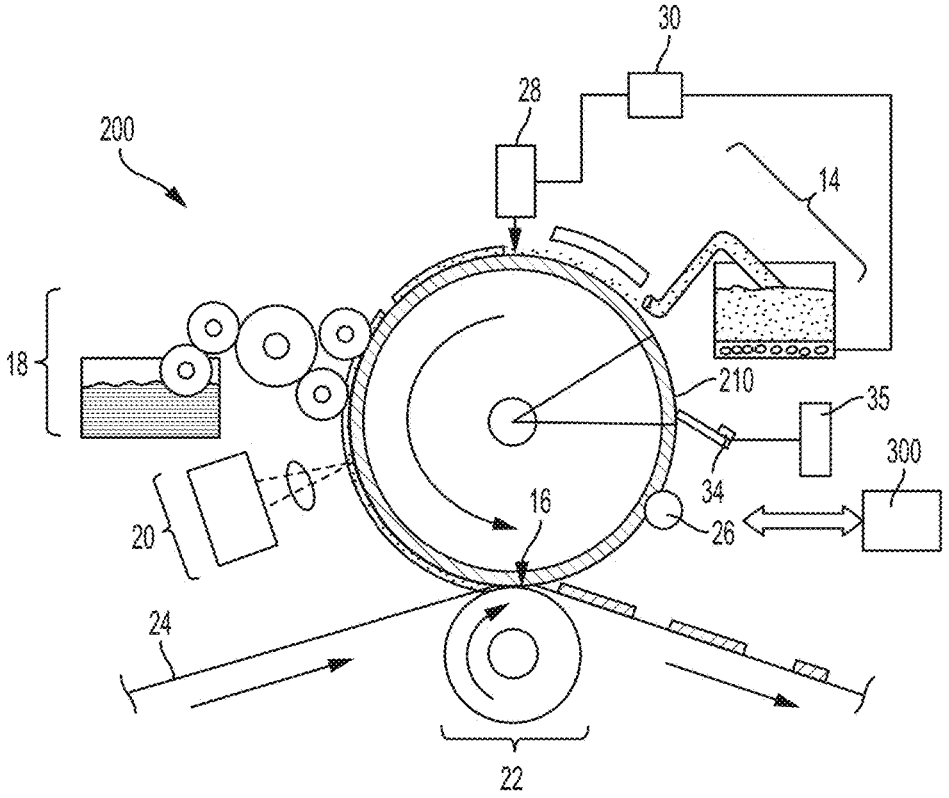
FIG. 2 is a side view of a system for variable lithography including a condensation-based dampening fluid and thermal printhead subsystem in accordance to an embodiment.

FIG. 2 is a side view of a system 200 for variable lithography including a condensation-based dampening fluid or fountain solution (FS) and thermal printhead subsystem in accordance to an embodiment. Note that portions of the system for variable lithography which are the same as those in FIG. 1 are denoted by the same reference numerals, and descriptions of the same portions as those described above with reference to FIG. 1 will be omitted. Before formation of layer over imaging member 12 by the dampening fluid subsystem 14, a latent print pattern is formed on imaging member 12 by selectively heating portions thereof using thermal printhead subsystem 34. When heat is applied to imaging member 12, either by a thermal print head or by another heating mechanism, the heating will transfer onto the imaging member a series of pixels that produce a picture, logo, lettering and the like. The portion of the blanket that is at an elevated temperature is then subjected to vapors that condense on blanket and because of the heat a layer with voids coinciding with the portion where heat was applied will form thereon. It will be appreciated that details regarding driving circuitry 35 controlling thermal printhead subsystem 34 are beyond the scope of the present disclosure, but that embodiments for such driving circuitry will be available to one skilled in the art. The positioning of the thermal printhead subsystem 34 relative to the dampening subsystem 14 is based on many factors. Such a gap 210 or the distance between the subsystems is based on dwell time of the blanket 12 within the vapor chamber (see FIG. 4 below), chemical composition of the dampening fluid solution, surface characteristics of blanket 12, and the applied heat by the printhead 34 that can range from 50° C. to 1,000° C. The thickness data and the intensity data of the heat may be used to provide feedback to control (controller 300) the metering of the dampening fluid and the heat applied to the blanket.

The controller 300 may be embodied within devices such as a desktop computer, a laptop computer, a handheld computer, an embedded processor, a handheld communication device, or another type of computing device, or the like. The controller 300 may include a memory, a processor, input/output devices, a display and a bus. The bus may permit communication and transfer of signals among the components of the controller 300 or computing device.

Figure 3:
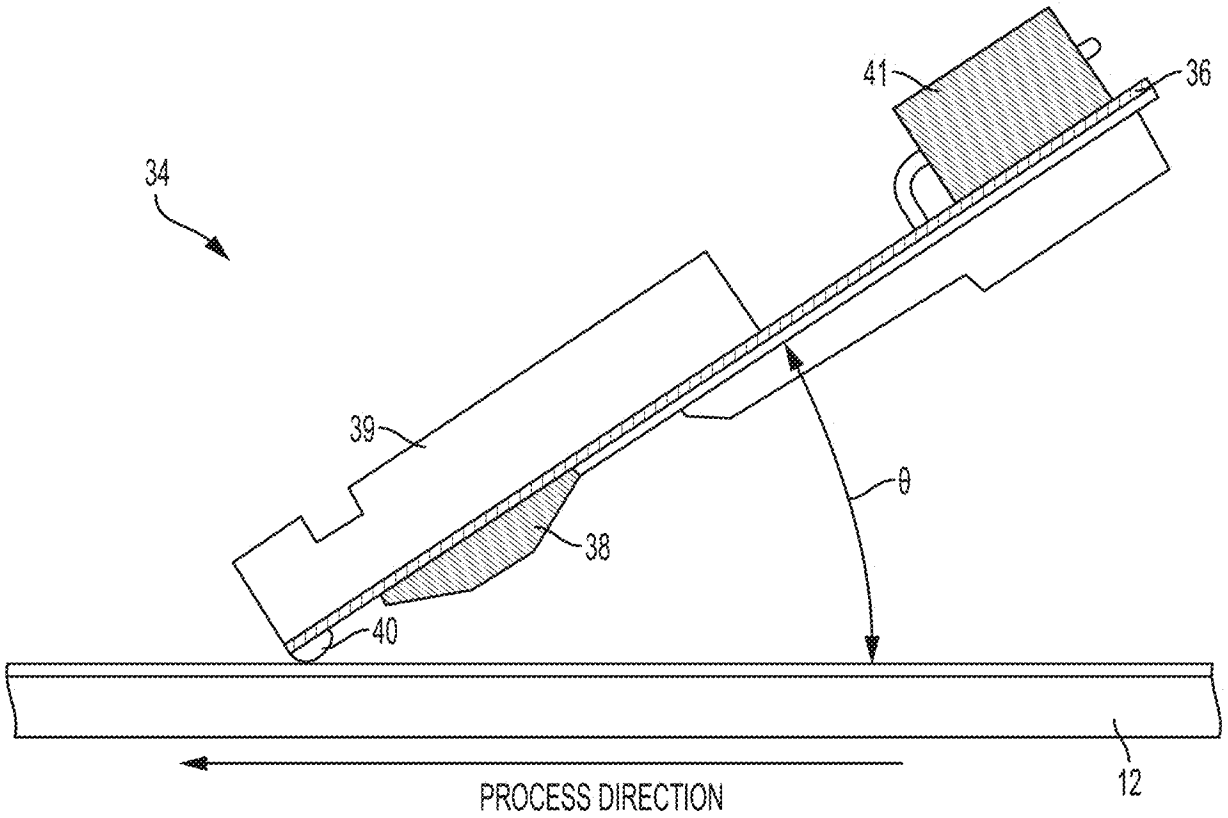
FIG. 3 is side view of a thermal printhead (TPH) subsystem in accordance to an embodiment.

FIG. 3 is side view of a thermal printhead (TPH) subsystem 34 in accordance to an embodiment.

It will be appreciated that many different embodiments of a thermal printhead subsystem may provide the functionality disclosed herein, and the description of thermal printhead subsystem (printhead) 34 is illustrative and limited only by the scope of the claims appended hereto. Printhead 34 comprises a substrate 36 carrying a driver circuit 38 communicatively coupled to a heating element 40. Optionally, driver circuitry may be formed and carried separate from substrate 36. Substrate 36 is typically made from a high thermal conductivity ceramic material that can efficiently carry away excess heat away from the head heaters at 40 to a metal heat sink 39. Other circuitry, mechanical elements such as 41, and mounting components may also be carried by substrate 36.

Figure 4:
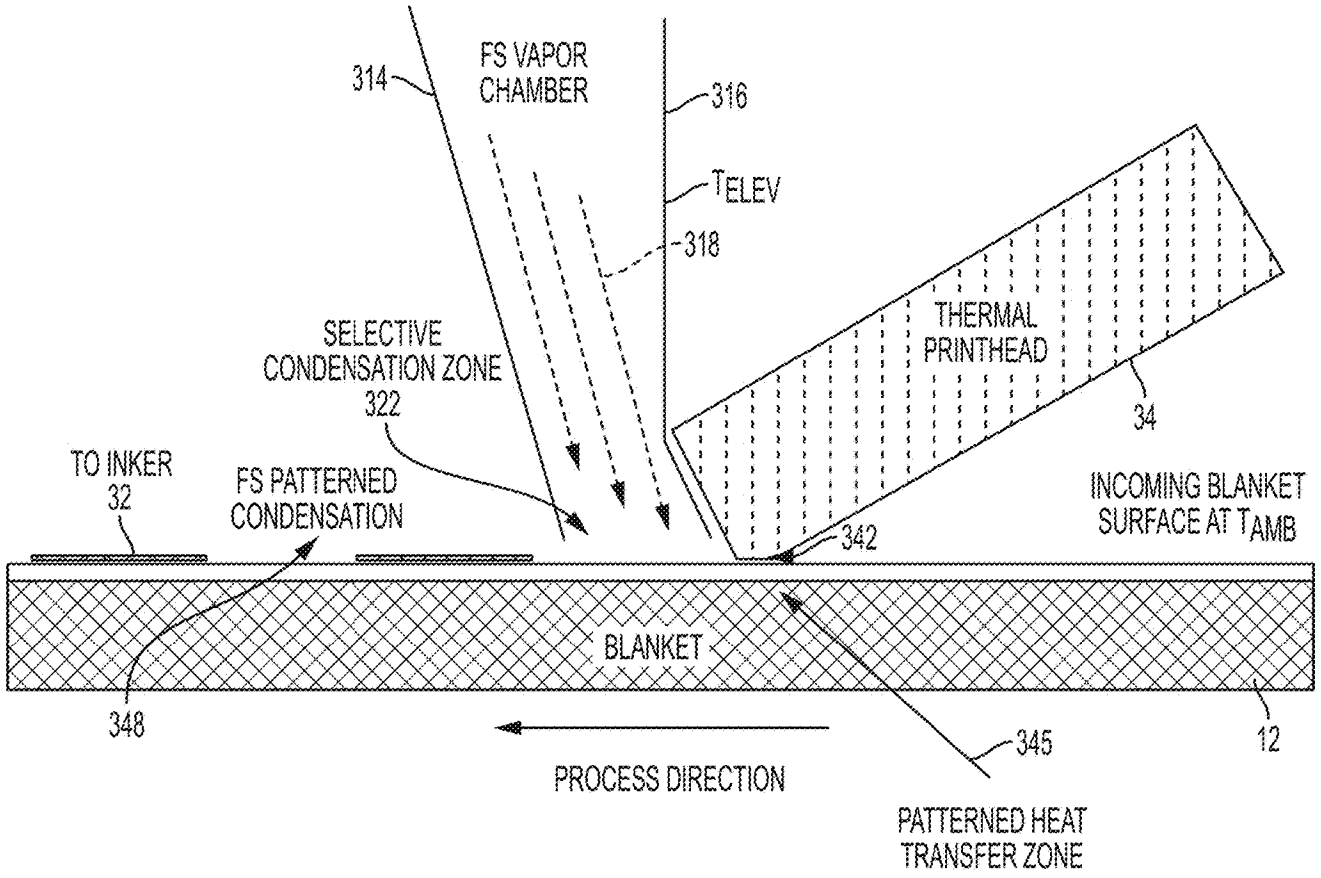
FIG. 4 shows a position of the thermal printhead and condensation chamber for manufacturing dampening solution film with voids in accordance to an embodiment.

In the embodiment depicted in FIG. 2, FIG. 4 and FIG. 3, thermal printhead 34 is in close proximity to the arbitrarily reimageable surface 12 such that it touches the upper layer formed thereover with a contact pressure in a wiper blade configuration having a shallow angle (θ). Whereas most conventional thermal printing heads use 125 to 256 current pulses to create a single grayscale pixel for photofinishing applications, in the arrangement in FIG. 3 (and as also shown in FIG. 4 and FIG. 2) only one single pulse is needed to form a dot. Such a dot may correspond to a 600 dpi or 1200 dpi dot size. Because the thermal energy is transmitted directly to the arbitrarily reimageable surface, thermal printhead 34 will be in contact with reimageable surface upstream before the dampening fluid is applied.

Figure 6:
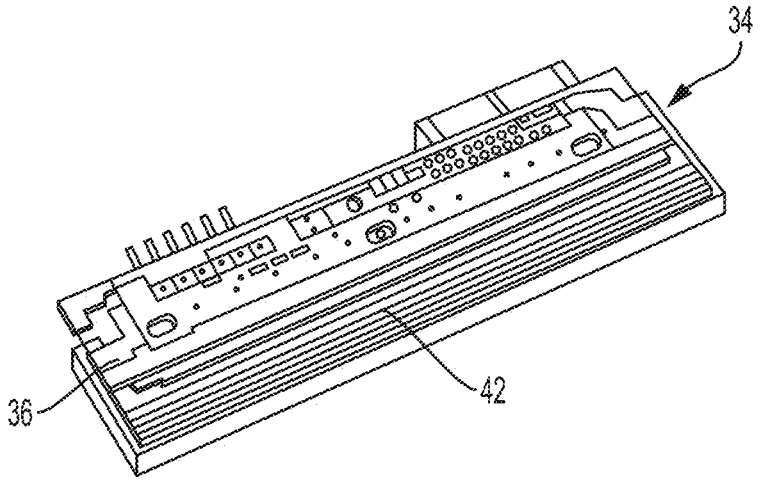
FIG. 6 is an illustration of a representative thermal printhead with substrate and distal ends in accordance to an embodiment.

Referring next to FIG. 6, a perspective view of a thermal printhead 34 is shown. In such an element, a current is passed through an array of electrically resistive elements 42 disposed at or near the proximal end of thermal printhead subsystem 34. The resistance produces a local temperature increase at the energized resistive elements 42. The temperature increase is sufficient to heat a region of the blanket 12 to produce heated regions that after application of dampening solution would result in a thin layer with voids for receiving ink or other marking material. In one example, printhead 34 may consist of an off-the-self 1200 dpi thermal print head system. Designs for a full printhead may include a wide common ground electrode (not shown) on the backside of the substrate 36 to eliminate common voltage loading, such as for wide formats. Alternatively, printhead 34 may consist of a proprietary OEM design optimized for wide format and high speed operation.

Figure 7:
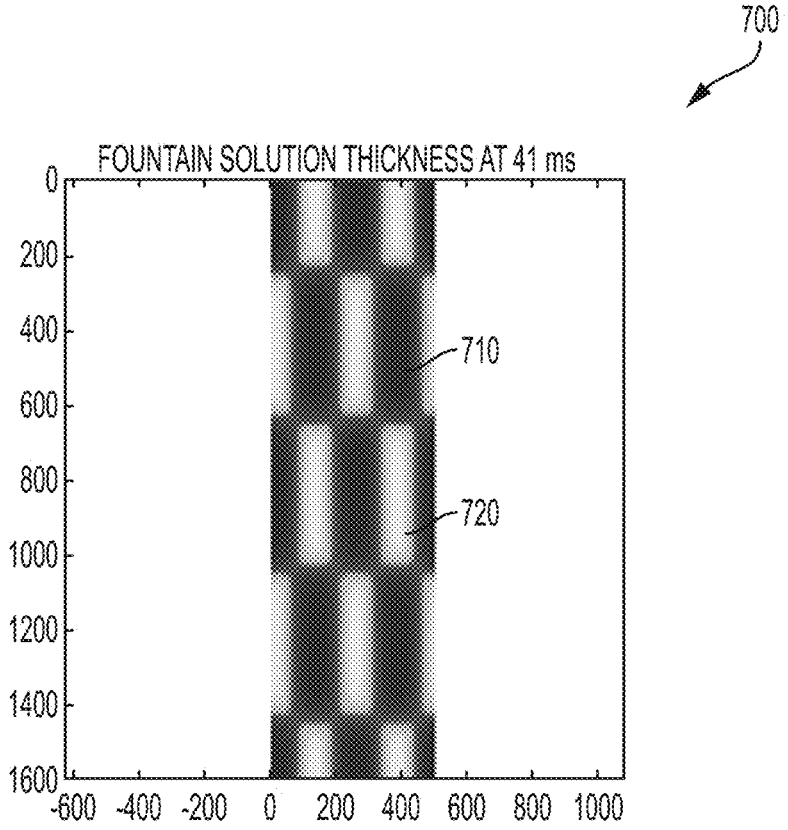
FIG. 7 is a checkerboard pattern showing dampening solution film created by patterned preheat and condensation vapor in accordance to an embodiment.

It will be appreciated from FIG. 6 that a thermal printhead 34 will include multiple resistive elements arranged laterally across the end of the thermal printhead to produce multiple, parallel rows in order to build up a latent image after the dampening fluid is applied, as illustrated in FIG. 7. It is desirable for a single thermal printhead to have sufficient width in the lateral direction to span the full image width of the printing system. It is also possible to incorporate multiple narrower thermal printheads to span the full image width, in which case each thermal printhead 42 must be closely spaced to its neighboring thermal printheads in order that the adjacent voids of dampening solution will slightly overlap so as to form larger lateral regions on the reimageable surface with no remaining dampening solution.

FIG. 4 shows a position of the thermal printhead and condensation chamber for manufacturing dampening solution film with voids in accordance to an embodiment.

FIG. 4 shows a schematic view of an embodiment of this disclosure. A 'near edge' TPH 34 is positioned so that it contacts the blanket 12 surface as shown. The TPH 32 is oriented such that its linear array of heating elements is along the cross-process direction. The blanket 12 is conformable so that intimate contact 342 is achieved across the full width of the TPH 34. The TPH device is intended to operate under significant contact pressure so this is a reasonable application of its capabilities. Immediately adjacent and downstream of the TPH 34 is a dampening or fountain solution (FS) vapor chamber 314 with flow control structure such as a manifold (not shown) and flow conduit having walls 316. This chamber 314 contains a heated 'cloud' of FS vapor 318 which is exposed to the blanket over a constrained area known as the condensation zone 322. The walls 316 of chamber 314 are kept at an elevated temperature ($T_{ELEV}$). Thus the only surface available for the FS to condense upon is the blanket 12. The vapor density is controlled such that vapor 318 will rapidly condense onto the blanket 12 when it is at ambient temperature ($T_{AMB}$). When the blanket surface is at an elevated temperature at area known as the patterned heat transfer zone 345, vapor will not condense upon it. The airflow within the vapor chamber can also be controlled to facilitate this process.

In operation, the blanket surface 12 is at ambient temperature ($T_{AMB}$) as it passes under the TPH 34, where it is selectively heated to temperature TH which is the range of 100 to 1000° C. The blanket 12 then passes through the FS vapor chamber 314. The portions of the blanket 12 that were not preheated will have FS condense 32 on them, whereas the preheated areas will not since the temperature TH will not support condensation. By confining with a flow control structure and a flow conduit a condensation region to support forming a dampening fluid layer with voids at the arbitrarily reimageable surface. The dwell time of the blanket within the vapor chamber is selected such that the preheated areas do not have time to cool to the temperature at which condensation occurs like ambient Temperature ($T_{AMB}$). Thus the blanket 12 now has an image-wise patterned layer 32 of FS on it as it next travels to the inking nip.

There are advantages to using patterned heat transfer zone 345 rather than to directly heat a film of previously applied fountain solution (FS). There are several concerns with direct heating of the FS film by the TPH: the TPH contact zone may disturb the uniformity of the film layer; any contaminant particles may wedge into the upstream side of the TPH nip and cause streaks in the FS film; and removal of evaporated FS in the vicinity of the TPH may be challenging, which can lead to re-condensation onto the blanket. The embodiment of FIG. 4 avoids these concerns. The critical design challenge is to provide a FS vapor cloud within the FS chamber that deposits sufficient film thickness onto the unheated areas of the blanket in a short enough travel distance such that no condensation occurs onto the heated areas 322. The thermal properties of the blanket 12 top layer can be selected to enable this behavior. For example, a blanket top layer with relatively low thermal conductivity would resist both lateral and radial heat conductance.

Figure 5:
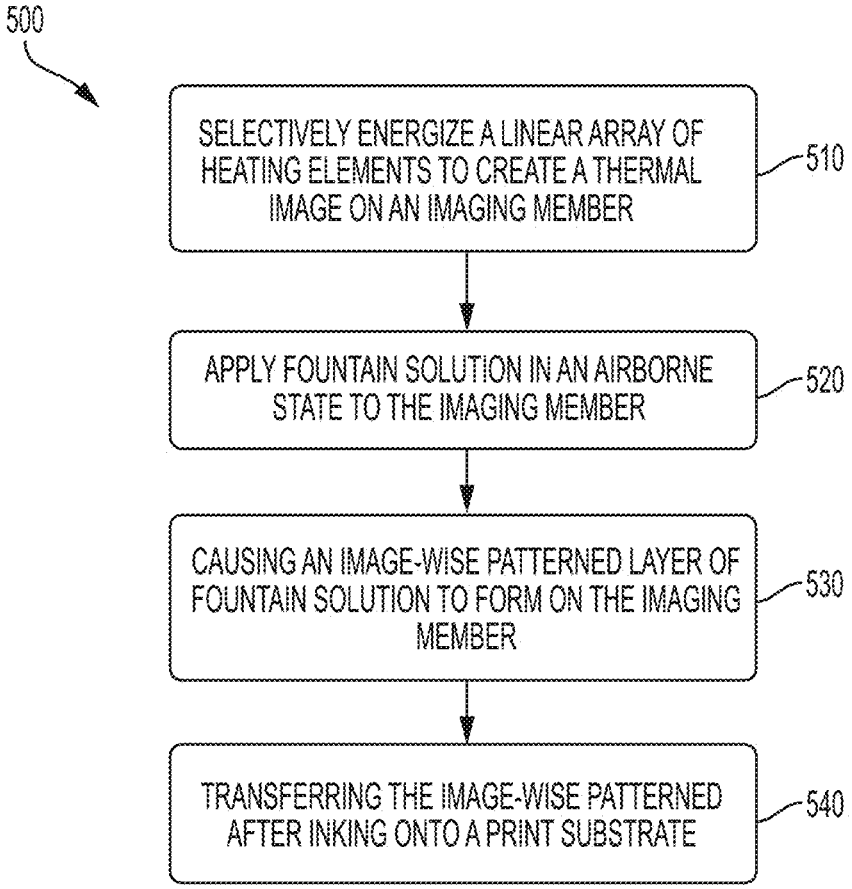
FIG. 5 is a flowchart of a method for patterned preheat of an arbitrarily reimageable surface in accordance to an embodiment.

FIG. 5 is a flowchart of a method 500 for patterned preheat of an arbitrarily reimageable surface in accordance to an embodiment.

Method 500 illustrates the operations of creating a heated pattern image, applying a dampening fluid or FS to form a layer with voids that attract or repels inks, and then transferring the now inked image to a print media such as paper. In operation, the blanket surface is at ambient temperature as it passes under the TPH, where it is selectively heated to temperature TH. The blanket then passes through the FS vapor chamber. The portions of the blanket that were not preheated will have FS condense on them, whereas the preheated areas will not. Method 500 begins with action 510 by selectively energize a linear array of heating elements (TPH) to create a thermal image on an imaging member; method 500 in action 520 then applies a fountain solution in an airborne state to the imaging member; in action 530 movement of the blanket under an aptly heated vapor chamber causes an image-wise patterned layer of fountain solution to form on the imaging member, i.e., a layer having voids where heat energy was applied; and, then in action 540 transferring the image-wise patterned after inking onto a print substrate.

FIG. 6 is an illustration of a representative thermal printhead with substrate and distal ends in accordance to an embodiment.

FIG. 6 shows a representative thermal printhead (TPH) device. The thermal printhead has an array of selectively-activatable thermal elements 42 that are selectively activated and a pressure activated mechanism (not shown) keeps the elements in thermal contact with a blanket as it rotates during process operations. The most common application for TPH devices is in Point-of-Sale (POS) devices where they are used together with either a thermal transfer ribbon or with coated thermal paper. The TPH is composed of a substrate 36, a generally linear array of heating pads or elements 42, and electronics to energize the elements according to externally received data like from controller 300. The elements are glazed or encapsulated so they do not directly contact the ribbon or media in such application as POS. TPH devices are available in resolutions of up to 400 dpi, although for special applications they can have resolutions of 600 to 1200 dpi. Resolution is measured along the element array. In one example, heating element may form a part of an off-the-self 1200 dpi thermal print head system, such as model G5067 from Kanematsu USA. TPH devices work strictly through resistive heating and total output power can exceed 200-300 W. Most TPH devices have their elements on the flat surface of their substrate; this tends to constrain the diameter of the backing roll which forms the heating nip to be small, generally less than 20 mm. Some TPH devices have their heater elements on the corner or the edge of the substrate, which allows a much larger diameter backing roll, as is the case for digital lithography imaging.

FIG. 7 is a checkerboard pattern 700 showing a dampening solution film created by patterned preheat and condensation vapor in accordance to an embodiment.

FIG. 7 shows a print media produced using the disclosed embodiments in the form of a 5×5 checkerboard pattern using a native 600 dpi TPH. The checkerboard image is still apparent, and the condensed FS film thickness such as 720 is deemed to be sufficiently thick to reject ink while the non-condensed FS film such as 710 would accept ink. Further improvements in image quality are possible by optimizing the blanket like arbitrarily imaging member 12 thermal properties to suit this preheating imaging mode as described in FIGS. 2, 3, and 5. For example, the topmost layer of the blanket could be made of a material with lower thermal conductivity which will reduce the rate of heat diffusion into the blanket as well as laterally into unheated areas.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus useful in printing with a variable data lithographic system having an arbitrarily reimageable surface, comprising:

a thermal printhead element disposed proximate the arbitrarily reimageable surface;

driving circuitry communicatively connected to the thermal printhead for selectively temporarily heating the thermal printhead to an elevated temperature;

whereby portions of the arbitrarily reimageable surface proximate the thermal printhead are heated by the thermal printhead when the thermal printhead is at the elevated temperature;

a flow control structure that confines airborne dampening fluid provided from a flow conduit to a condensation region to support forming a dampening fluid layer with voids at the arbitrarily reimageable surface.

2. The apparatus of claim 1, wherein the thermal printhead comprises:

a substrate having distal end;

a thermal element carried by the substrate at the distal end;

whereby the thermal printhead is disposed within the variable data lithographic system such that the distal end of the substrate is closer to the arbitrarily reimageable surface.

3. The apparatus of claim 2, wherein the thermal element comprises an array of thermal resistors.

4. The apparatus of claim 2, wherein the driving circuitry is further carried by the thermal printhead substrate.

5. The apparatus of claim 1, wherein the thermal printhead is disposed so as to be in physical contact with the arbitrarily reimageable surface when the thermal printhead is at the elevated temperature.

6. The apparatus of claim 5, wherein the flow control structure is a manifold having at least one nozzle formed therein so as to direct a gas flow from the manifold in the direction of the arbitrarily reimageable surface in the condensation region.

7. The apparatus of claim 6, wherein the heated portions of the arbitrarily reimageable surface proximate the thermal printhead exceed a temperature in the condensation region such that condensation of dampening fluid on the heated portions is inhibited.

8. The apparatus of claim 1, wherein the flow control structure is immediately adjacent and downstream of the thermal printhead element.

9. The apparatus of claim 8, wherein the flow conduit is maintained at a temperature such that condensation of dampening fluid on the flow conduit is inhibited.

10. The apparatus of claim 8, further comprising:

a dampening fluid reservoir configured to provide through the flow conduit dampening fluid in an airborne state to the arbitrarily reimageable surface.

11. A method of forming a latent image over an arbitrarily reimageable surface of an imaging member for receiving ink and transfer of said ink to a print substrate, comprising:

producing a latent image on said arbitrarily reimageable surface by:

disposing a thermal printhead element in contact with said arbitrarily reimageable surface layer;

driving the thermal printhead to selectively temporarily heat said thermal printhead to an elevated temperature, whereby portions of said arbitrarily reimageable surface are heated when said thermal printhead is at said elevated temperature;

confining with a flow control structure and a flow conduit a condensation region to support forming a dampening fluid layer with voids at the arbitrarily reimageable surface;

applying ink over said arbitrarily reimageable surface layer such that said ink selectively occupies said voids to thereby produce an inked latent image; and transferring the inked latent image to a print substrate.

12. The method of claim 11, wherein the thermal printhead heats the arbitrarily reimageable surface by:

using a substrate having distal end with a thermal element that is disposed such that the distal end of the substrate is closer to the arbitrarily reimageable surface.

13. The method of claim 12, wherein the thermal element comprises an array of thermal resistors.

14. The method of claim 12, wherein the driving circuitry is further carried by the thermal printhead substrate.

15. The method of claim 11, wherein the thermal printhead is disposed so as to be in physical contact with the arbitrarily reimageable surface when the thermal printhead is at the elevated temperature.

16. The method of claim 15, wherein the flow control structure is a manifold having at least one nozzle formed therein so as to direct a gas flow from the manifold in the direction of the arbitrarily reimageable surface in the condensation region.

17. The method of claim 16, wherein the heated portions of the arbitrarily reimageable surface proximate the thermal printhead exceed a temperature in the condensation region such that condensation of dampening fluid on the heated portions is inhibited.

18. The method of claim 11, wherein the flow control structure is immediately adjacent and downstream of the thermal printhead element.

19. The method of claim 18, wherein the flow conduit is maintained at a temperature such that condensation of dampening fluid on the flow conduit is inhibited.

20. The method of claim 18, wherein the dampening fluid at the arbitrarily reimageable surface is received from a dampening fluid reservoir in an airborne state.

* * * * *